US006062646A

United States Patent [19]

Bock

[11] Patent Number: 6,062,646

[45] Date of Patent: May 16, 2000

[54] ADJUSTABLE-HEIGHT ARMREST, IN PARTICULAR FOR AN OFFICE CHAIR

[75] Inventor: Hermann Bock, Pyrbaum, Germany

[73] Assignee: Bock 1 GmbH & Co., Postbauer-Heng, Germany

[21] Appl. No.: 09/153,160

[22] Filed: Sep. 15, 1998

[51] Int. Cl.[7] ..... A47C 7/54

[52] U.S. Cl. ..... 297/411.36; 297/353; 248/118.3

[58] Field of Search ..... 297/411.36, 353; 248/118.3

[56] References Cited

U.S. PATENT DOCUMENTS

| | | | |
|---|---|---|---|
| 5,435,626 | 7/1995 | Lai | 297/411.36 |
| 5,678,893 | 10/1997 | Bock | 297/353 |
| 5,725,278 | 3/1998 | Verbeek | 297/353 |
| 5,796,497 | 6/1998 | Tsai | 297/411.36 |
| 5,848,823 | 12/1998 | Su | 297/411.36 |
| 5,918,938 | 7/1999 | Miotto | 297/353 |

FOREIGN PATENT DOCUMENTS

| | | | |
|---|---|---|---|
| B-76302/91 | 11/1992 | Australia | 297/411.36 |

*Primary Examiner*—Peter M. Cuomo
*Assistant Examiner*—Rodney B. White
*Attorney, Agent, or Firm*—Browdy and Neimark

[57] ABSTRACT

An adjustable-height armrest is provided with an armrest column, an armrest carrier which is telescopically displaceable in height on the column, an arm support located thereon and a catching system for fixing the armrest carrier with respect to the armrest column in graduated height positions. The catching system consists, on the one hand, of a double row, extending vertically in the armrest column, of mutually aligned latching recesses which are connected to one another via slots. A locking unit comprising two mutually engaging locking bolts which are displaceable relative to one another is also arranged on the armrest carrier. These locking bolts each have a latching head for the latching recesses and a narrower web adapted to the contour of the orifices. The webs are aligned with the orifices when the locking unit is released.

14 Claims, 4 Drawing Sheets

ADJUSTABLE-HEIGHT ARMREST, IN PARTICULAR FOR AN OFFICE CHAIR

BACKGROUND OF THE INVENTION

1. Field of the Invention

The invention relates to a adjustable-height armrest, in particular for an office chair or the like.

2. Background Art

Adjustable-height armrest constructions with an armrest column designed as a round tube and an armrest carrier which can be displaced telescopically on this column and is also designed as a round tube are commercially available. In order to fix the arm support located on the armrest carrier, a catching device is provided between armrest carrier and armrest column. For reasons of production and operation, it is normally necessary when designing such catching systems that they are, on the one hand, as simple as possible in construction but, on the other hand, ensure reliable, conveniently operated catching. Furthermore, the prevention of rotation of the armrest is particularly important in round tube constructions.

SUMMARY OF THE INVENTION

On the basis of the foregoing problems with known round tube armrests, the object of the invention is to improve the catching system thereof with respect to constructional simplicity, ease of operation and simultaneous prevention of rotation of the column.

This object is achieved by an armrest, in particular for an office chair or the like, with an armrest column designed as a round tube, an armrest carrier which is telescopically displaceable in height on the column and is also designed as a round tube, an arm support located on the armrest carrier and a catching system for fixing the armrest carrier with respect to the armrest column in graduated height positions, characterized in that the catching system consists, on the one hand, of a double row, extending vertically in the opposing walls of the armrest column, of mutually aligned latching recesses which are connected to one another via slots and, on the other hand, of a locking unit which is arranged on the armrest carrier and comprises two mutually engaged locking bolts which are displaceable relative to one another and of which each is provided with a latching head adapted to the contour of the latching recesses and a narrower web adapted to the contour of the slots in such a way that, when the locking unit is latched, the latching heads are located in the respective latching recesses while catching the armrest carrier in the vertical direction and rotational direction and in that, when the locking unit is released, the webs of the locking bolts are aligned with the slots for height adjustment of the armrest. Owing to the latching recesses connected to one another via slots and the corresponding adaptation of the locking bolts of the locking unit with latching head and a narrower web, the locking unit remains inside the orifice formed by the latching recesses and the slots in both operating positions and therefore always prevents rotation of the armrest carrier relative to the armrest column. At the same time, the catching system is particularly simple to operate as it is only necessary to press together the two locking bolts which are displaceable relative to one another, in order to release the locking unit. Finally, owing to the design according to the invention, the catching system only requires a small number of individual parts which are easy to produce and assemble.

Preferred embodiments of the invention relate to advantageous developments with respect to the catching system, which will be described in more detail with reference to the embodiment.

A further preferred embodiment of the armrest according to the invention refers to a configuration in which the arm support can be rotated even though the armrest carrier is fixed in the rotational direction by the catching system. This is often desired for typical functional chairs, for example for chairs at computer workstations, to allow better adaptation of the position of the arm support. Further features, advantages and details will emerge from the following description in which an embodiment of the subject of the invention is described in more detail with reference to the accompanying drawings.

DESCRIPTION OF THE PREFERRED EMBODIMENT

Figure 1:
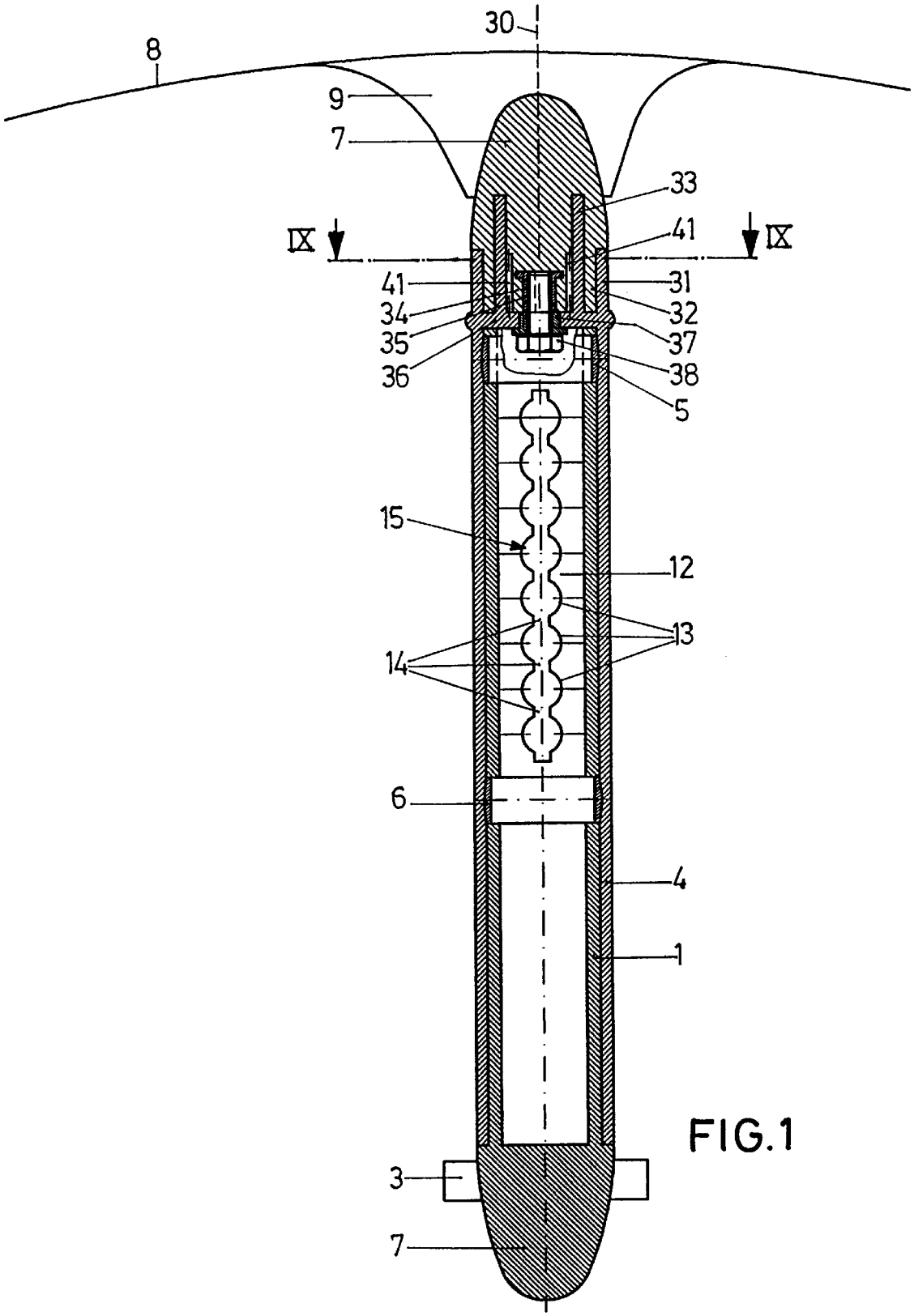
FIG. 1 is a vertical section through an armrest in the longitudinal direction of the armrest.
Figure 2A:
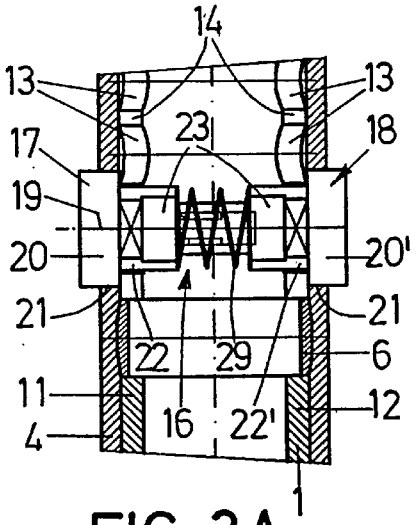
FIG. 2, 2A and 3 are vertical sections through this armrest transversely to the longitudinal direction of the armrest at various height positions.
Figure 2:
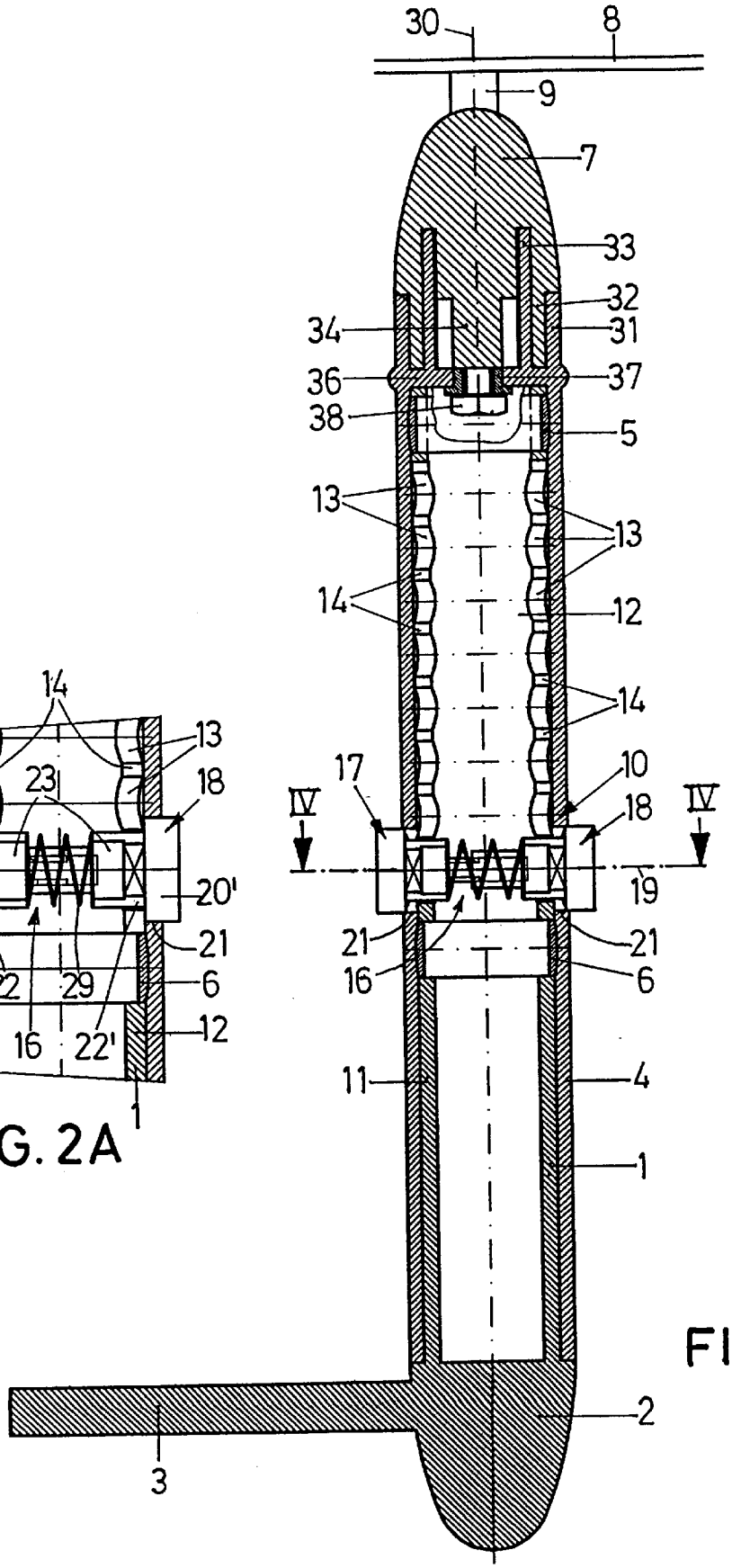
Figure 3:
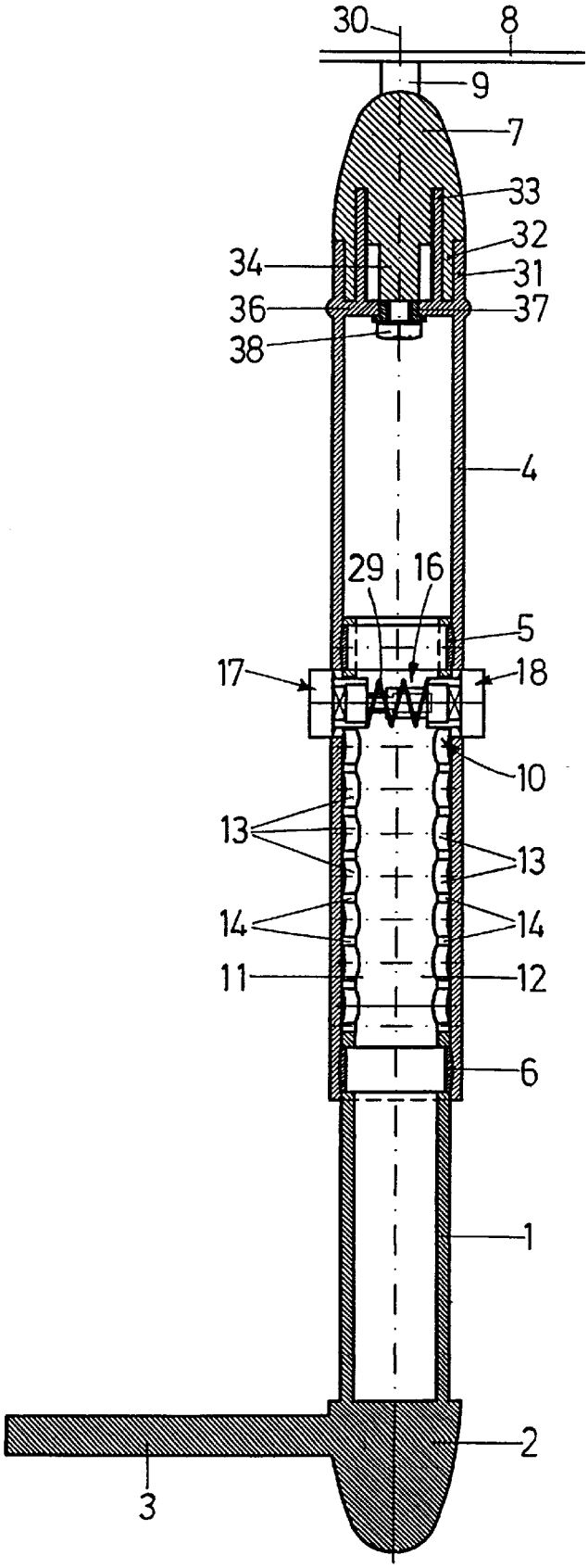
Figure 4:
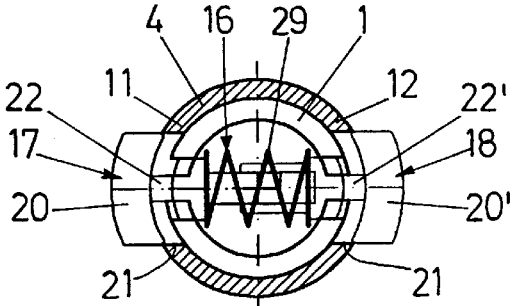
FIG. 4 is a horizontal section along section line IV—IV in FIG. 2.

FIG. 1 to 3 show the basic construction of the adjustable-height armrest. It has an armrest column 1 which is designed as a round tube and is formed integrally with a solid foot 2. The foot 2 is provided with an anchoring strut 3 with which the armrest can be fastened, for example, on the seat carrier of an office chair. Armrest column 1 with foot 2 and anchoring strut 3 can be injection molded from a suitable plastics material or can be produced from aluminum.

An armrest carrier 4 which is also designed as an injection molded round tube part and is telescopically displaceable in height relative to the armrest column 1 is also located on the column 1. To permit a clean sliding movement of the carrier 4 relative to the column 1, the column 1 is provided at the upper end and substantially in the central region with a respective sliding ring 5, 6 of plastics material, for example in the form of POM (polyoxymethylene) which is convex in design at its peripheral surface. These sliding rings 5, 6 rest against the internal wall of the tubular carrier 4.

On the armrest carrier 4 there is located an armrest head 7 which will be described in more detail hereinafter and on which the actual arm support 8 of the armrest is arranged via a corresponding connecting part 9. The two last-mentioned parts are indicated merely schematically in the figures. The drawings also show a catching system which is designated as a whole by reference numeral 10 and serves to fix the armrest carrier 4 with respect to the armrest column 1 in graduated height positions. FIG. 2 shows the lowest position and FIG. 3 the highest position of the armrest carrier 4 relative to the column 1.

The part of the catching system 10 associated with the armrest column 1 consists of a double row, extending vertically in the opposing internal and external walls 11, 12 of the column 1, of latching recesses 13 which are mutually aligned in height and have substantially circular contours. The latching recesses 13 are connected to one another via slots 14 so, in the general view (FIG. 1), an orifice 15 having substantially the form of a string of pearls, is formed in the internal and external wall 11, 12 of the armrest column.

The part of the latching system 11 arranged on the armrest carrier 4 consists of the so-called locking unit 16 which is composed of two mutually engaging locking bolts 17, 18 which can be displaced relative to one another. The longitudinal axes 19 of the locking bolts 17, 18 extend coaxially to one another and horizontally diametrically with respect to the tubular armrest carrier 4. The outwardly directed actuating knobs 20, 20' of the two locking bolts 17, 18 are designed in the form of flat cylinders and are displaceably mounted in circular orifices 21 in the tube wall of the armrest carrier 4 parallel to the longitudinal axis 19. The actuating knob 20, 20' is adjoined by a respective narrow web 22, 22' of which the thickness d is smaller than the internal width of the slots 14. The contour of the webs 22, 22' is therefore adapted to the slots 14.

At the free end of the webs 22, 22' there is formed a respective latching head 23 whose flat cylindrical shape has a contour adapted to the latching recesses 13.

Figure 5:
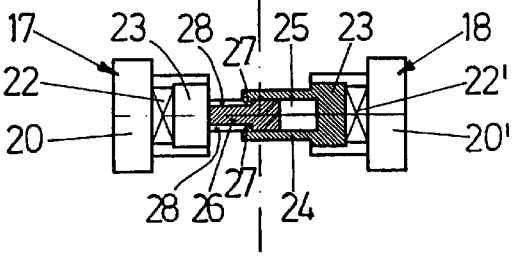
FIG. 5 and 6 are partially sectional side views of the locking unit in the catching and releasing position.
Figure 7:
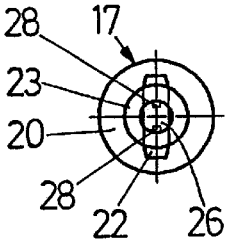
FIG. 7 and 8 each show end views of the locking bolt forming the locking unit.
Figure 6:
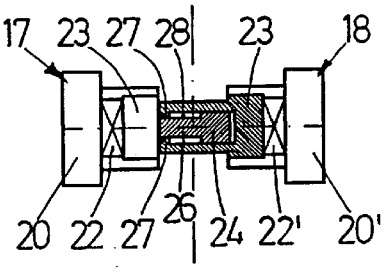
Figure 8:
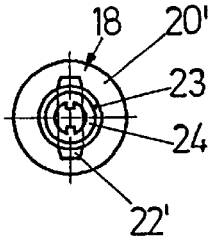

As shown in particular in FIG. 5 and 6, the latching heads 23 each have guide elements, extending coaxially to the longitudinal axis 19, for the telescopic guidance of the two locking bolts 17, 18 relative to one another. This is a sleeve part 24 on the locking bolt 18 in whose internal orifice 25 there engages a plunger part 26 of the locking bolt 17 which is displaceable along this internal orifice 25. The sleeve part 24 is provided at its free end with inwardly springing stops 27 which extend in corresponding grooves 28 on the shank of the plunger part 26. As the grooves 28 do not penetrate to the free end of the plunger part 26, the displacement length of the two locking bolts 17, 18 is limited. The two extreme positions of the two parts relative to one another are shown in FIG. 5 and 6, namely the extended position in FIG. 5 and the retracted position in FIG. 6. As also shown in FIG. 1 to 4, the two locking bolts are spring-loaded in mutually opposed directions (that is in the direction of the latching position, as will be explained hereinafter). For this purpose, a helical compression spring 29 is located on the sleeve part 29 and rests with its two ends on the ends of the latching heads. The catching system operates in the following manner:

In the caught position, as shown in FIG. 2 and FIG. 3, 4 and 5, the two locking bolts 17, 18 are pressed apart by the helical compression spring 29, the latching heads 23 being located in the respective latching recesses 13. Catching of the armrest carrier both vertically and against rotation of the carrier relative to the column 1 is thus guaranteed. The two actuating knobs 20, 20' project well beyond the outer periphery of the armrest carrier 4 in this position. In this state, the boundary regions of the webs 22, 22' projecting upwardly and downwardly beyond the latching heads 23 also engage in the slots 14 so the locking bolts 17, 18 are also secured against rotation round their own longitudinal axis 19.

For height adjustment, the two locking bolts 17, 18 are driven together against the helical compression spring 29 by an actuation of the knobs 20, 20' so the latching heads 23 pass from the corresponding latching recesses 13 inwardly and the webs 22, 22' which are narrower than the latching heads 23 are vertically aligned with the slots 14 between the latching recesses (FIG. 2A). Catching in the vertical direction is therefore eliminated When the locking bolt 17, 18 is pressed together, the armrest carrier can be displaced along the orifice 15, the rotational catching of the armrest carrier 4 relative to the armrest column 1 never being lost. To fix the armrest carrier 4, for example in the upper extreme position shown in FIG. 3, the actuating knobs 20, 20' merely need to be released so the latching heads 23 can snap back into the corresponding latching recesses 13.

The above-described armrest head 7, like the armrest carrier 4, is designed as an injection molded plastics part or aluminum part. The armrest head 7 is basically rotatably mounted about the vertical axis 30. To enable the armrest head 7 to be supported adequately against transverse forces to the vertical axis 30, armrest head 7 and the upper end of the armrest carrier 4 have projecting annular collars 31, 32, 33 which fit into one another. Also on the armrest head 7 there is provided a centrally arranged projection 34 in which is injected a threaded bush 35 which is open at the bottom A receiving sleeve 37, in which a screw 38 which can be fixed in the threaded bush 35 can be inserted from below, is inserted correspondingly coaxially in the covering wall 36 of the armrest carrier 4. The armrest head 7 is therefore secured at the top from removal from the armrest carrier 4.

Figure 9:
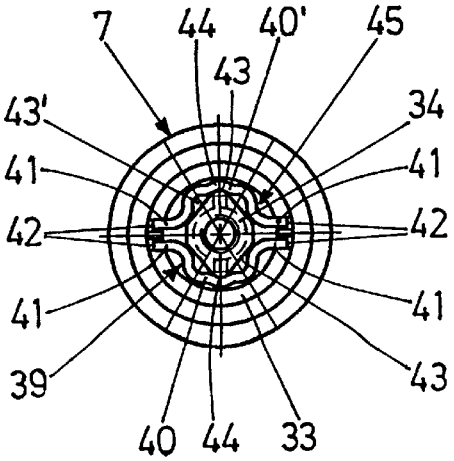
FIG. 9 is a horizontal section through the head of the armrest along section line IX—IX in FIG. 1.

In order to achieve the basic armrest position shown in FIG. 1 with respect to a rotation round the vertical axis 30 and further preferred positions deflected inwardly or outwardly from this basic position, the projection 34 lying coaxially with the axis of rotation (vertical axis 30) is designed polygonally in its outer contour. As shown in FIG. 9 the outer contour is, in particular, substantially rhombic, the corner regions being rounded.

The projection 34 designed in this way cooperates with a leaf spring arrangement 39 formed from two substantially omega-shaped leaf springs 40, 40'. The leaf springs 40, 40' are arranged in a vertical orientation in the free space 45 between the projection 34 and the internal annular collar 33. They stand foot 41 to foot 41 and are fixed by the free ends of their feet 41 in a respective slot 42 in the innermost annular collar 33. The leaf spring arrangement 39 is therefore rigid with respect to the armrest carrier 4.

Catching indentations 43 which are mutually angularly offset and cooperate with the corner regions 44 of the polygonal contour of the projection 34 are formed by the corrugation of the leaf springs 40, 40' shown in FIG. 9. Deflection of the armrest head 7 and therefore of the arm support 8 by an angle W of +/−30° inwardly or outwardly is therefore possible from the basic position shown in FIG. 9, in which the two opposing corner regions 44 are located in the central catching indentations 43. In these deflected positions, the comer regions 44 of the projection 34 are located in the lateral catching indentations 43'.

What is claimed is:

1. An adjustable-height armrest, inn particular for an office chair comprising an armrest column (1) designed as a round tube, an armrest carrier (4) which is telescopically displaceable in height on the armrest column (1) and is also designed as a round tube, an arm support (8) located on the armrest carrier (4), and a catching system (10) for fixing the armrest carrier (4) with respect to the arrest column (1) in graduated height position, wherein the catching system (10) consists of a double row, extending vertically in an opposing walls (11, 12) of the armrest column (1), of mutually aligned latching recesses (13) which are connected to one another via slots (14) and of a locking unit (16) which is arranged on the armrest carrier (4) and comprises two mutually engaged locking bolts (17, 18) which are displaceable relative to one another and of which each is provided with a latching head (23) adapted to a contour of the latching recesses (13) and a narrower web (22, 22') adapted to a contour of the slots (14) in a way that, when the locking unit (16) is latched, the latching heads (23) are located in respective latching recesses (13) while catching the armrest carrier (4) in vertical direction and rotational direction and in that, when the locking unit (16) is released, the webs (22, 22') of the locking bolts are aligned with the slots (14) for height adjustment of the armrest, wherein the locking bolts (17, 18) can be displaced relative to one another by means of a telescopic guide (24, 25, 26).

2. An armrest according to claim 1, wherein the relative displacement length of the two locking bolts (17, 18) is limited by stops (27).

3. An armrest according to claim 1, wherein the locking bolts (17, 18) are spring loaded in a direction of a catching position.

4. An armrest according to claim 1, comprising a helical compression spring (29) located on the telescopic guide (24, 25, 26).

5. An armrest according to claim 1, comprising an armrest head (7) which is mounted on the armrest carrier (4) so as to rotate about a vertical axis (30) and carries the arm support (8).

6. An armrest according to claim 5, wherein the armrest head (7) can be fixed in a basic armrest position and at least one rotated position by a rotation catching device (34, 39).

7. An armrest according to claim 6, wherein the rotation catching device is formed by a polygonal projection (34) on the armrest head (7) located coaxially with the axis of rotation (30) and a leaf spring arrangement (39) on the armrest carrier (4) which surrounds the projection (34) while forming catching indentations (34) which are angularly offset from one another.

8. An armrest according to claim 7, wherein the leaf spring arrangement (39) is formed by two substantially omega-shaped leaf springs (40, 40') arranged foot (41) to foot (41).

9. An adjustable-height armrest, in particular for an office chair comprising an armrest carrier (1) designed as a round tube, an armrest carrier (4) which is telescopically displaceable in height on the armrest column (1) and is also designed as a round tube, an arm support (8) located on the armrest carrier (4), a catching system (10) for fixing the armrest carrier (4) with respect to the armrest column (1) in graduated height positions, wherein the catching system (10) consists of a double row, extending vertically in an opposing walls (11, 12) of the armrest column (1), of mutually aligned latching recesses (13) which are connected to one another via slots (14) and of a locking unit (16) which is arranged on the armrest carrier (4) and comprises two mutually engaged locking bolts (17, 18) which are displaceable relative to one another and of which each is provided with a latching head (23) adapted to a contour of the latching recesses (13) and a narrower web (22, 22') adapted to a contour of the slots (14) in such a way that, when the locking unit (16) is latched, the latching heads (23) are located in respective latching recesses (13) while catching the armrest carrier (4) in vertical direction and rotational direction and in that, when the locking unit (16) is released, the webs (22, 22') of the locking bolts are aligned with the slots (14) for height adjustment of the armrest, and am armrest head (7), which is mounted on the armrest carrier (4) so as to rotate about a vertical axis (30) and carries the arm support (8), wherein the armrest head (7) can be fixed in a basic armrest position and at least one rotated position by a rotation catching device (34, 39) and wherein the rotation catching device is formed by a polygonal projection (34) on the armrest head (7) located coaxially with the axis of rotation (30) and a leaf spring arrangement (39) on the armrest carrier (4) which surrounds the projection (34) while forming catching indentations (34) which are angularly offset from one another.

10. An armrest according to claim 9, wherein the locking bolts (17, 18) can be displaced relative to one another by means of a telescopic guide (24, 25, 26).

11. An armrest according to claim 9, wherein the relative displacement length of the two locking bolts (17, 18) is limited by stops (27).

12. An armrest according to claim 9, wherein the locking bolts (17, 18) are spring loaded in a direction of a catching position.

13. An armrest according to claim 9, comprising a helical compression spring (29) located on the telescopic guide (24, 25, 26).

14. An armrest according to claim 9, wherein the leaf spring arrangement (39) is formed by two substantially omega-shaped leaf springs (40, 40') arranged foot (41) to foot (41).

* * * * *